US005899031A

United States Patent [19]

Nagaoka et al.

[11] Patent Number: 5,899,031

[45] Date of Patent: May 4, 1999

[54] PARTITION STRUCTURE HAVING A SCREEN

[75] Inventors: Tadayoshi Nagaoka, Tondabayashi; Takuzo Nakamura, Sendai, both of Japan

[73] Assignee: Tadayoshi Nagaoka, Japan

[21] Appl. No.: 08/864,261

[22] Filed: May 28, 1997

[51] Int. Cl.[6] ..... E02D 19/12; E04C 2/32

[52] U.S. Cl. ..... 52/169.5; 52/169.14; 52/302.1; 52/741.11; 405/43; 405/45

[58] Field of Search ..... 52/169.5, 169.14, 52/302.1, 741.11, 741.3, 741.4; 405/36, 43, 45, 50

[56] References Cited

U.S. PATENT DOCUMENTS

| | | | |
|---|---|---|---|
| 3,654,765 | 4/1972 | Healy et al. | 52/169.5 X |
| 4,162,866 | 7/1979 | Kita et al. . | |
| 4,574,541 | 3/1986 | Raidt et al. | 52/169.5 |
| 4,840,515 | 6/1989 | Freese | 52/169.5 X |
| 4,865,069 | 9/1989 | Lacey | 52/169.5 X |
| 4,943,185 | 7/1990 | McGuckin et al. | 52/169.5 X |
| 4,956,951 | 9/1990 | Kannankeril | 52/169.5 |
| 5,017,042 | 5/1991 | Minor et al. | 52/169.5 X |
| 5,046,892 | 9/1991 | Kothmann | 405/43 |
| 5,190,404 | 3/1993 | Kiyokawa et al. | 405/45 |
| 5,263,792 | 11/1993 | Davis et al. | 52/169.5 X |
| 5,511,346 | 4/1996 | Kenworthy | 52/169.5 |
| 5,584,610 | 12/1996 | Simpson et al. . | |
| 5,688,073 | 11/1997 | Brodeur et al. | 52/169.5 X |

FOREIGN PATENT DOCUMENTS

| | | |
|---|---|---|
| 524422 | 4/1931 | Germany . |
| WO9220872 | 11/1992 | WIPO . |

*Primary Examiner*—Carl D. Friedman
*Assistant Examiner*—Timothy B. Kang
*Attorney, Agent, or Firm*—Hedman, Gibson & Costigan, P.C.

[57] ABSTRACT

A partition structure having a screen includes a pair of main wall members disposed in parallel to each other with a predetermined interval, a pair of side wall members connected at end portions thereof to the end portions of the pair of main wall members to connect said main wall members to each other and provide a partition space defined by said main wall members and said side wall members, and one or more spacer members disposed in said partition space and fixed to said main wall members to hold the main wall members in positon. At least a part of at least one of the main wall members and the spacer members being a screen. The partition structure may further include a top member and a bottom member closing the partition space, and a communicating tube communicating with the partition space through the top plate.

5 Claims, 9 Drawing Sheets

PARTITION STRUCTURE HAVING A SCREEN

BACKGROUND OF THE INVENTION

This invention relates to a partition structure having a screen and a method for using the same.

In building an underground construction such as an underground part of a building, it is necessary to pump out underground water in the construction site and thereby lower the underground water level before starting the underground construction. Known in the art of drainage works is a method called "deep well method". According to this method, as shown in FIG. 15, sheet piles b are driven into the ground around the site a. Then, a plurality of deep well screens c are buried into the ground in the site a to a level under the underground water level. Pumps P are connected to the deep well screens c and underground water flowing into the deep well screens c is pumped out by the pumps P to lower the underground water level in the site a to a desired water level L.

As described above, the deep well method requires two stage works of (1) construction of a partition wall by driving in of sheet piles and (2) burying deep well screens in the site surrounded by the partition wall and, therefore, this method requires much labor and time resulting in a high construction cost.

It is, therefore, an object of the present invention to overcome the above described problem in the conventional deep well screen engineering process.

SUMMARY OF THE INVENTION

For achieving the above described object of the invention, there is provided a partition structure having a screen comprising a pair of main wall members disposed in parallel to each other with a predetermined interval therebetween, a pair of side wall members connected at end portions thereof to the end portions of the pair of main wall members to connect said main wall members to each other and provide a partition space defined by said main wall members and said side wall members, and one or more spacer members disposed in said partition space and fixed to said main wall members to hold the main wall members in position, at least a part of at least one of said main wall members and said spacer members being a screen.

According to the invention, by producing a partition by installing a plurality of the partition structures of the invention in the construction site instead of employing the conventional deep well method, the construction site inside of the partition is interrupted from the underground water stratum outside of the construction site and underground water inside the partition can be drained to the outside through the screen. Accordingly, the underground water in the construction site can be drained and the underground water level can be lowered to a desired level without using the deep well method.

Further, according to the invention, the partition structure is a much stronger structure than a partition made of sheet piles and, by filling concrete or other filling material into the partition space after completion of draining of underground water, the partition structure can be utilized as a wall structure of the underground portion of a building or other construction.

In one aspect of the invention, the partition structure having a screen further comprises a top member and a bottom member closing the partition space, and a communicating tube having one end thereof being received in the partition space through the top member and communicating with the partition space and the other end thereof being adapted to be connected to a draining pump.

According to this aspect of the invention, connection of the partition structure to the draining pump is facilitated.

In another aspect of the invention, in the partition structure having a screen, a filling material is filled in at least a part of the partition space. As filling materials, granular filtering materials, sound absorbing material and various other materials can be selectively used depending upon the purpose of the screen.

According to this aspect of the invention, the function of the partition structure as the screen can be enhanced.

In another aspect of the invention, there is provided a method for using a partition structure having a screen comprising steps of preparing for a plurality of partition structures each including a pair of main wall members disposed in parallel to each other with a predetermined interval therebetween, a pair of side wall members connected at end portions thereof to the end portions of the pair of main wall members to connect said main wall members to each other and provide a partition space defined by said main wall members and said side wall members, one or more spacer members disposed in said partition space fixed to said main wall members to hold the main wall members in position, at least a part of at least one of said main wall members being a screen, a top member and a bottom member closing the partition space, and a communicating tube communicating with the partition space, installing said plurality of partition structures side by side at least partly in ground with the screen facing inwardly and with the side wall members of the adjacent partition structures being in contact with each other thereby enclosing a predetermined construction site with said plurality of partition structures, connecting a draining pump to the communicating tube of the partition structure, and actuating the draining pump for draining underground water flowing into the partition space through the screen and thereby lowering the underground water level in the construction site.

In still another aspect of the invention, there is provided a method for using a partition structure having a screen comprising steps of preparing for a plurality of partition structures each including a pair of main wall members disposed in parallel to each other with a predetermined interval therebetween, a pair of side wall members connected at end portions thereof to the end portions of the pair of main wall members to connect said main wall members to each other and provide a partition space defined by said main wall members and said side wall members, and one or more spacer members disposed in said partition space fixed to said main wall members to hold the main wall members in position, at least a part of at least one of said main wall members being a screen, providing a drainage around a predetermined construction, installing said plurality of partition structures side by side at least partly in ground with the side wall members of the adjacent partition structures being in contact with each other, with one of the main wall members of the partition structures being adjacent to an outer wall surface of the predetermined construction, with the screens facing a side opposite to the main wall members adjacent to the outer wall of the predetermined construction, and with the lower portions of the partition structures being in communication with the drainage, thereby for draining underground water flowing into the partition space through the screen and lower the underground water level in the ground in the vicinity of the predetermined construction.

Other features and functions of the partition structure having a screen according to the invention will become apparent from the description of preferred embodiments made below with reference to the accompanying drawings.

BRIEF DESCRIPTION OF THE DRAWINGS

In the accompanying drawings.

DESCRIPTION OF PREFERRED EMBODIMENTS

Figure 1:
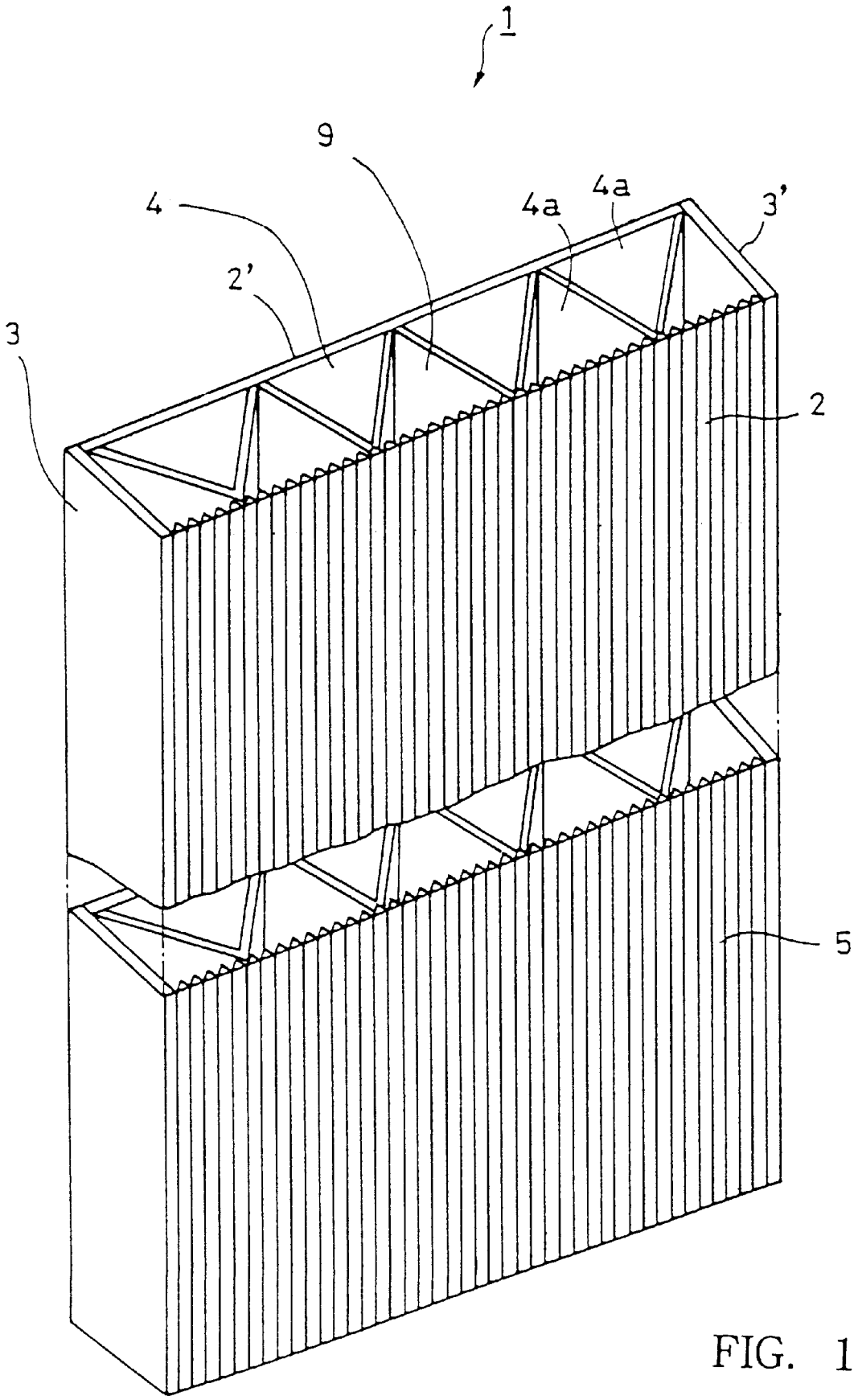
FIG. 1 is a perspective view showing an embodiment of the partition structure having a screen according to the invention.
Figure 2:
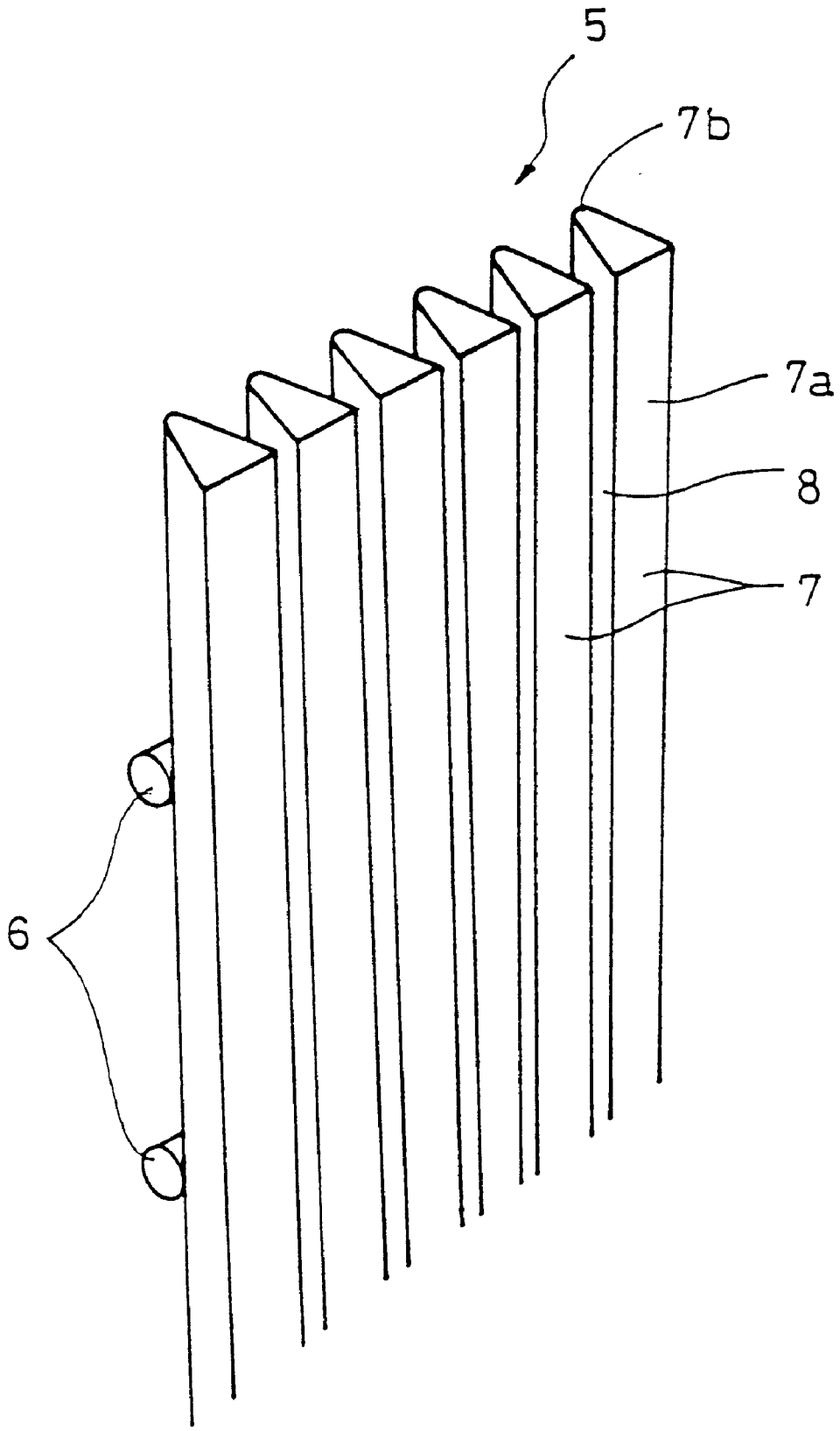
FIG. 2 is an enlarged perspective view showing a part of screen used in the embodiment.

Referring to FIGS. 1 and 2, an embodiment of the invention will be described.

A partition structure 1 has a pair of main wall members 2, 2' in the form of oblong flat plates which are disposed in parallel to each other with a predetermined interval between them. At the lateral ends of these main wall members 2, 2' are disposed a pair of side wall members 3, 3' in the form of oblong flat plates in the crossing direction to the main wall members 2, 2'. These side wall members 3, 3' are connected at lateral end portions thereof to the lateral end portions of the main wall members 2, 2' by suitable means such as welding to connect the main wall members 2, 2' to each other. A partition space 4 of a rectangular cross section is defined by the main wall members 2, 2' and the side wall members 3, 3'.

In this embodiment, the main wall member 2' is made of a steel plate. The main wall member 2 is constructed of a plate-like wedge wire screen 5. This wedge wire screen 5, as shown in an enlarged scale in FIG. 2, consists of support rods 6 arranged in parallel at a proper interval and wedge wires 7 which are arranged in a crossing direction to the support rods 6. The wedge wires 7 are arranged with their flat surfaces 7*a* facing outward and their projecting portions 7*b* facing inward and slots 8 of a predetermined width are formed between adjacent wedge wires 7. The projecting portions 7*b* are welded to the support rods 6 at each crossing point of the projecting portions 7*b* to the support rods 6.

In the partition space 4 are disposed spacer members 9 which hold the main walls 2, 2' in position. In this embodiment, the spacer members 9 consist of oblong steel plates which are arranged in the form of a corrugated plate. These spacer members 9 are arranged with their longitudinal direction coinciding with the longitudinal direction of the main wall members 2, 2'. The spacer members 9 are fixed in their lateral end portions to the main wall members by suitable means such as welding.

Figure 3:
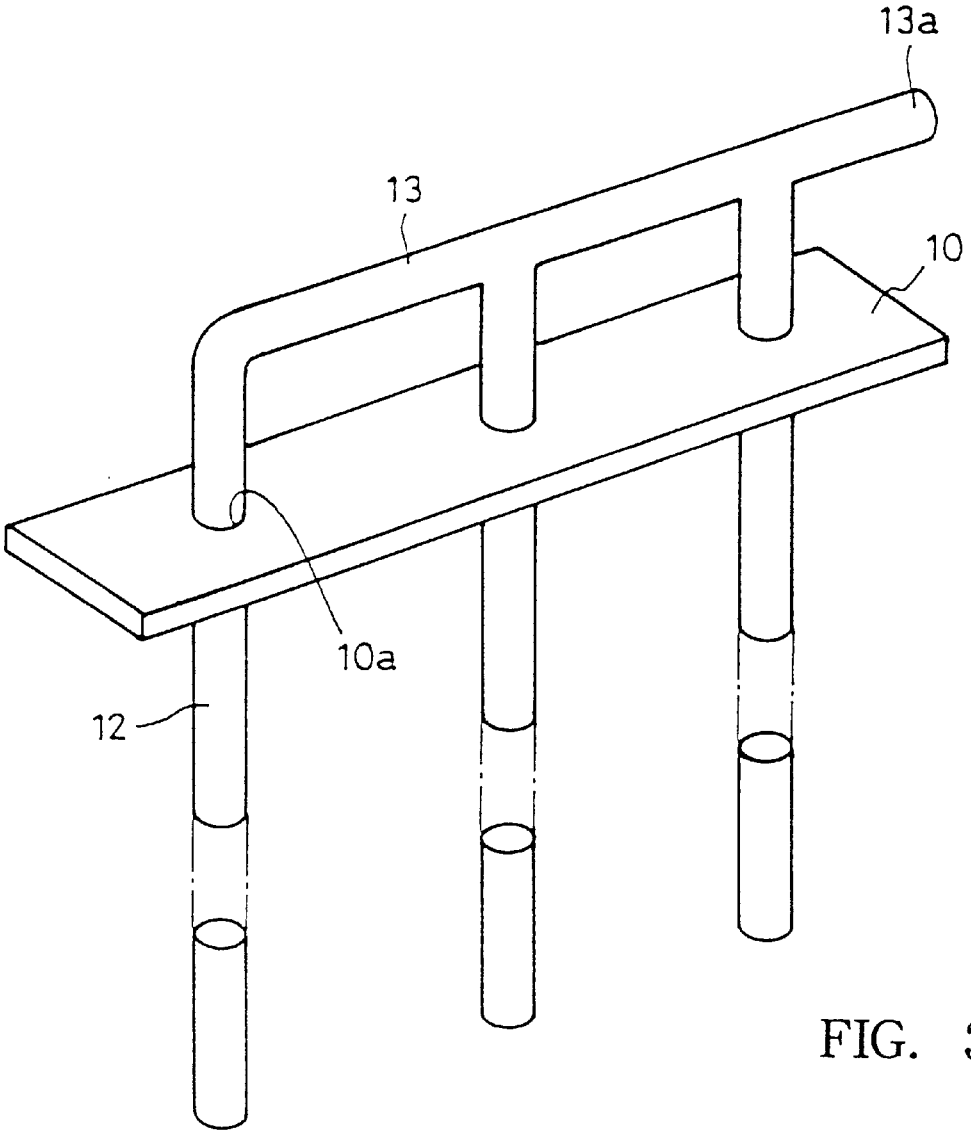
FIG. 3 is a perspective view showing an example of a top member and a communicating tube used in the above embodiment.
Figure 4:
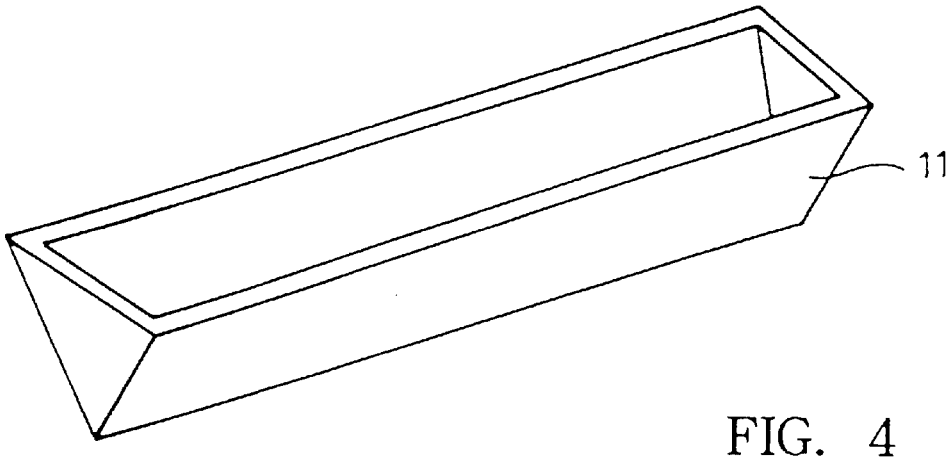
FIG. 4 is a perspective view showing an example of a bottom member used in the above embodiment.

In a case where the partition structure 1 having a screen is used for drainage work for lowering the underground water level instead of the deep well method, a top member 10 as shown in FIG. 3 and a bottom member 11 as shown in FIG. 4 are welded to the opening end portions of the partition structure 1 to close the opening ends of the partition space 4.

The top member 10 in the form of an oblong plate is formed with openings 10*a* provided for receiving a communicating tubes 12 and the communicating tubes 12 are fixedly received in these openings 10*a*. These communicating tubes 12 are designed to reach the lower portion of the partition structure 1 when they are fixedly received in the openings 10*a* and adapted to communicate the partition space 4 with a space outside of the partition structure 1. The communicating tubes 12 are respectively connected to a connecting tube 13 provided above the top member 10 and this connecting tube 13 is connected to a draining pump (not shown) through a connecting hose (not shown) which is connected to an end portion 13*a* of the connecting tube 13.

Each of the communicating tubes 12 may be inserted in each of channels 4*a* of a triangular cross section defined by the spacer members 9 and the main wall member 2, 2' or, alternatively, an opening may be formed in the spacer members 9 and the communicating tubes 12 may be inserted in selected ones of the channels 4*a* at a proper interval.

As shown in FIG. 4, the bottom member 14 has a top portion welded to the lower end portion of the partition structure 1 and has a projecting lower portion opposite to the top portion which lower portion is formed in the triangular shape in the vertical section for facilitating driving in of the partition structure 1 into the ground by hammering.

Figure 5:
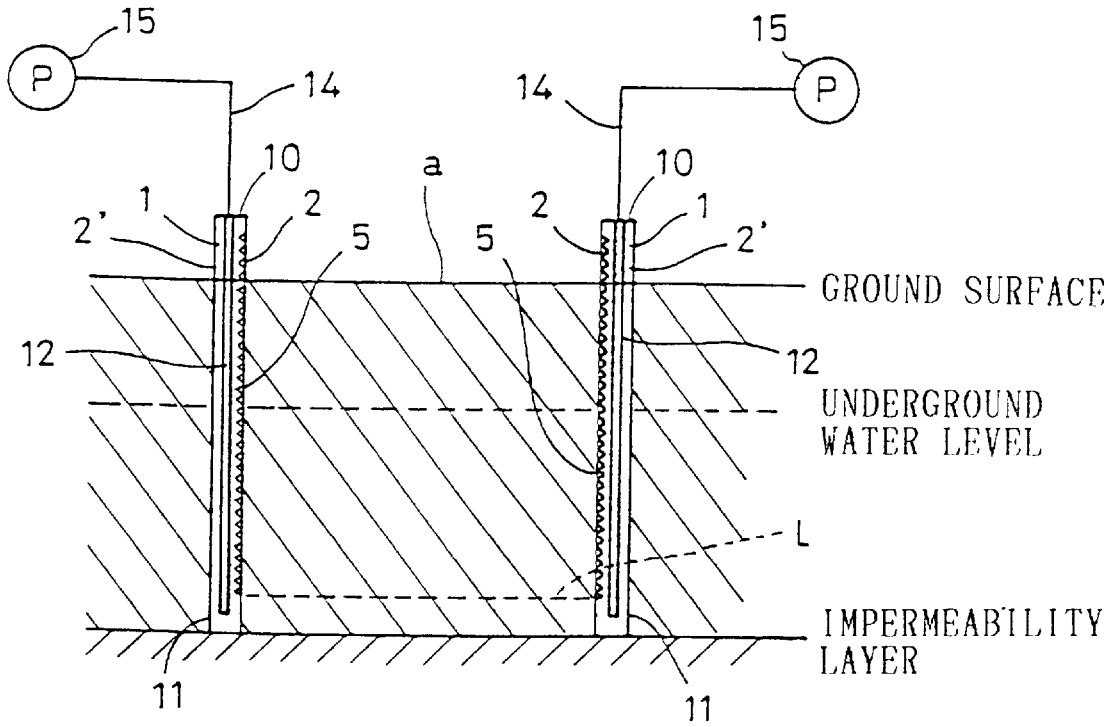
FIG. 5 is a view schematically showing a manner of use of the above embodiment.
Figure 15:
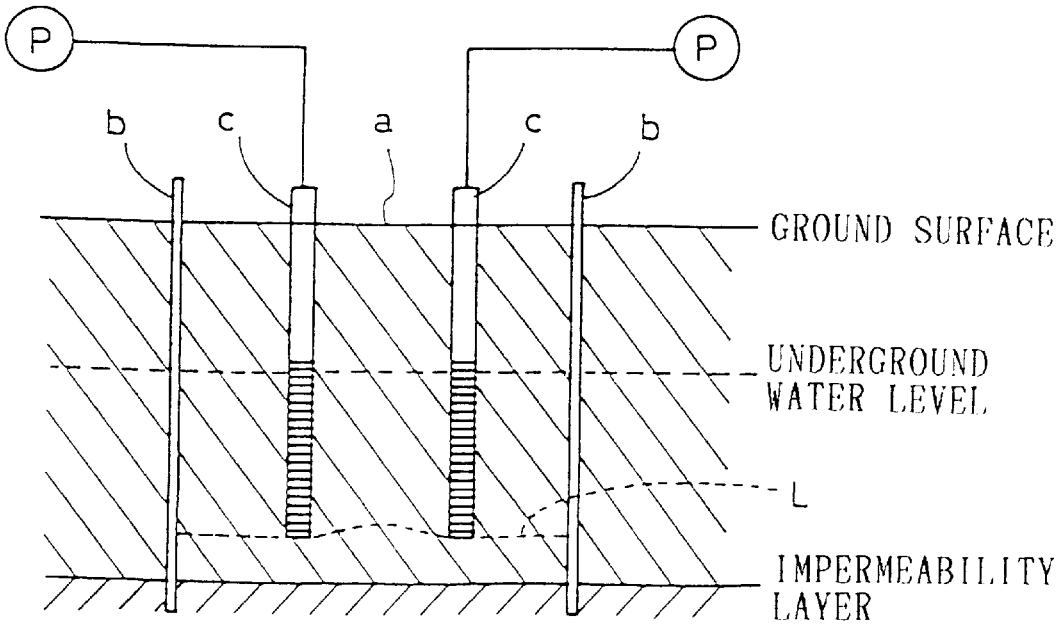
FIG. 15 PRIOR ART
FIG. 15 is a view showing the prior art deep well method.
Figure 6:
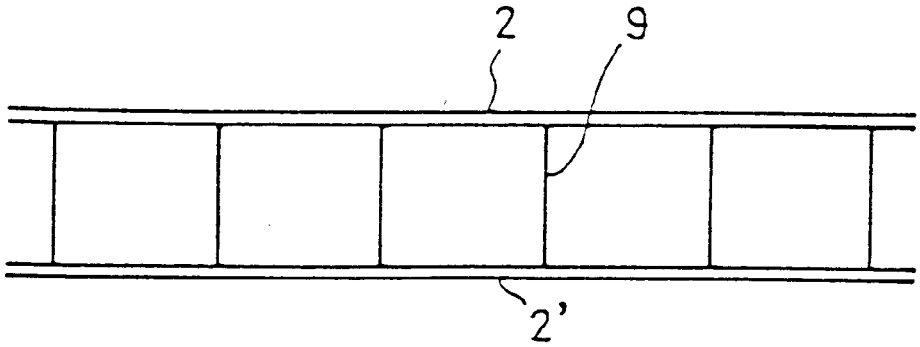
FIG. 6 is a plan view showing another example of spacer member.
Figure 7:
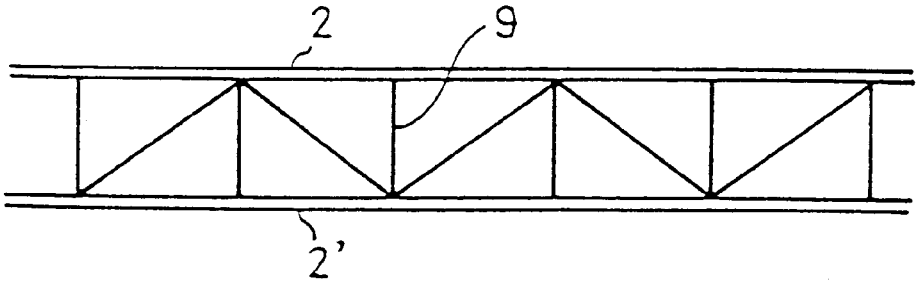
FIG. 7 is a plan view showing another example of spacer member.

Referring to FIG. 5, the partition structures 1 mounted with the top member 10, communicating tubes 12 and the bottom member 11 are driven into the ground one by one by hammering so that these partition structures 1 are disposed side by side with the side wall members 3, 3' of adjacent partition structures 1 come into contact with each other and with the main wall members 2 consisting of the wedge wire screens 5 facing inward thereby to enclose a predetermined construction site a. The communicating tubes 12 are connected to draining pumps 15 through connecting hoses 14.

Upon completion of preparation for the drainage work, the draining pumps 15 are actuated to drain underground water in the site a and thereby lower the underground water level to a desired level L.

Figure 8:
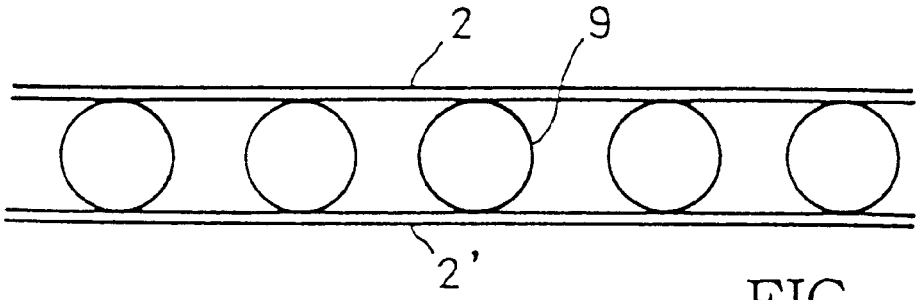
FIG. 8 is a plan view showing another example of spacer member.
Figure 9:
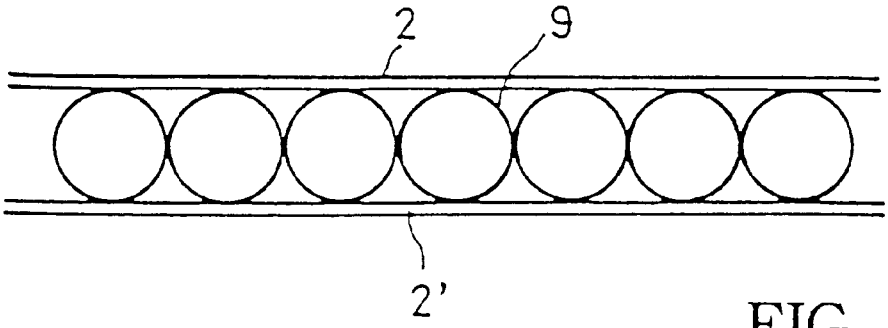
FIG. 9 is a plan view showing another example of spacer member.
Figure 10:
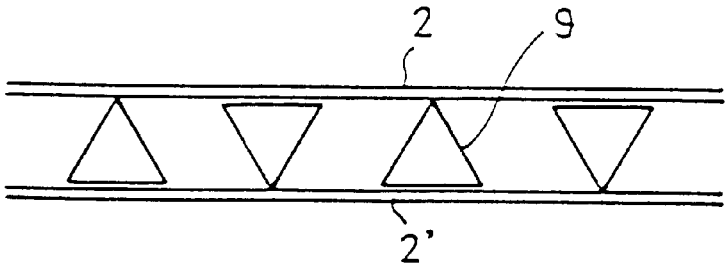
FIG. 10 is a plan view showing another example of spacer member.
Figure 11:
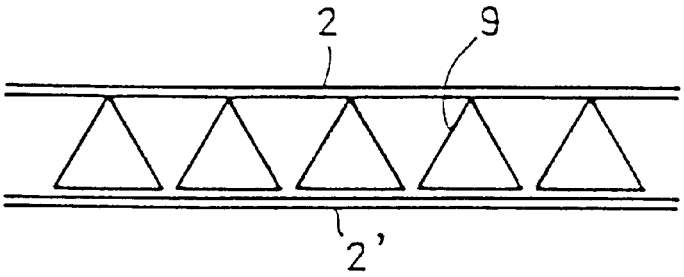
FIG. 11 is a plan view showing another example of spacer member.
Figure 12:
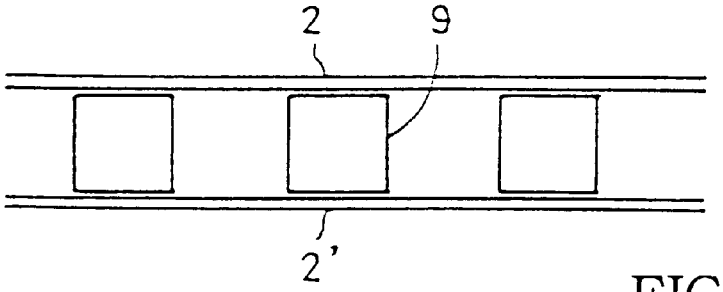
FIG. 12 is a plan view showing another example of spacer member.
Figure 13:
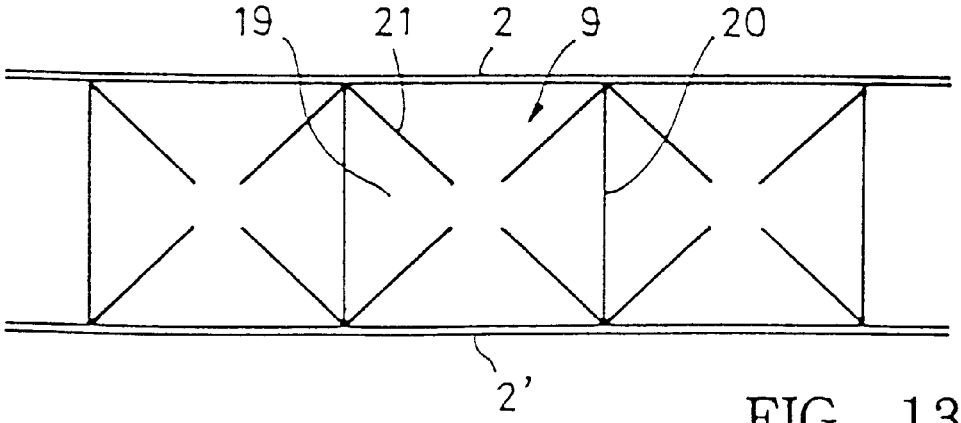
FIG. 13 is a plan view showing another example of spacer member.

In the above described embodiment, the spacer members 9 are made of steel plates arranged in the form of a corrugated plate. The shape and arrangement of the spacer member 9 is not limited to this but spacer members of various other designs can be employed. For example, cylindrical spacer members 9 may be arranged at a proper interval as shown in FIG. 8 or in contact with each adjacent spacer member 9 as shown in FIG. 9. Spacer members 9 of a triangular cross section may be arranged at a proper interval as shown in FIG. 10 or closely as shown in FIG. 11. Spacer members 9 of a square cross section may be arranged at a proper interval as shown in FIG. 12. Alternatively, the spacer members 9 may be composed of partition panels 20 which are arranged in a direction crossing the main wall members 2, 2' and inner diagonal panels 21 which are provided in each unit space 19 defined by the adjacent partition panels 20. Two pairs of inner diagonal panels 21 are provided substantially along diagonals of the rectangular cross section of each unit space 19. Each pair of the inner diagonal panels 21 are located on the same diagonal and each of the inner diagonal panels 21 has one end portion fixedly connected to the inner surface of one of the main wall members 2, 2' and an opposite end portion separated from an opposite end portion of the other inner diagonal panel 21 of the same pair by a predetermined distance in a central portion of the unit space 19. In other words, each pair of the inner diagonal panels 21 on the same diagonal are disontinuous in their opposite ends in the central portion of the unit space 19. The inner diagonal panels 21 serve for absorbing sound by absorbing vibration energy because the inner diagonal panels 21 reflect and diffuse vibration and sound. The inner diagonal panels 21 also serve as reinforcing members and thereby increase an earthquake-proof property of the partition structure.

In a case where a filling material is filled in the unit space 19, since the inner diagonal panels 21 are discontinuous in the central portion, the filling material can be filled in the unit space 19 from only one point of the unit space 19 and can be filled in the entire unit space 19 through the discontinuous central portion. Therefore, work for filling the filling material into the unit space 19 can be efficiently performed.

In the above described embodiment, a plurality of the partition structure 1 are installed to enclose a predetermined construction site. Additionally, in the construction site thus enclosed by the partition structures 1, a further set of partition structures 1 may be installed to enclose a central portion of the construction site. By this arrangement, draining of underground water in the construction site can be enhanced and accelerated. In this case, the partition structure 1 may have screens on both of the main wall members 2, 2'.

In the embodiment of FIG. 1, the entire main wall member 2 is made of the wedge wire screen 5. Alternatively, only a part of the main wall member 2, e.g., a central portion, may be made of a screen and the rest of the main wall member 2 may be made of a steel plate.

The above description has been made with respect to a case where the partition structure 1 according to the invention is used for draining underground water instead of the deep well method. However, the partition structure having a screen according to the invention is applicable not only to draining but various other purposes.

For example, a filtering material such as a granular filtering material may be filled in a part or whole of each channel 4*a* of the partition space 4 of the partition structure 1 of FIG. 1 so that the partition structure 1 can be used for filtering fluid.

In addition to the use described above, the partition structure 1 of FIG. 1 may be used as a frame or a back-filling member having a draining function for various purposes. Such applications include a retaining wall, subway and other underground passage, bridges and basements.

Figure 16:
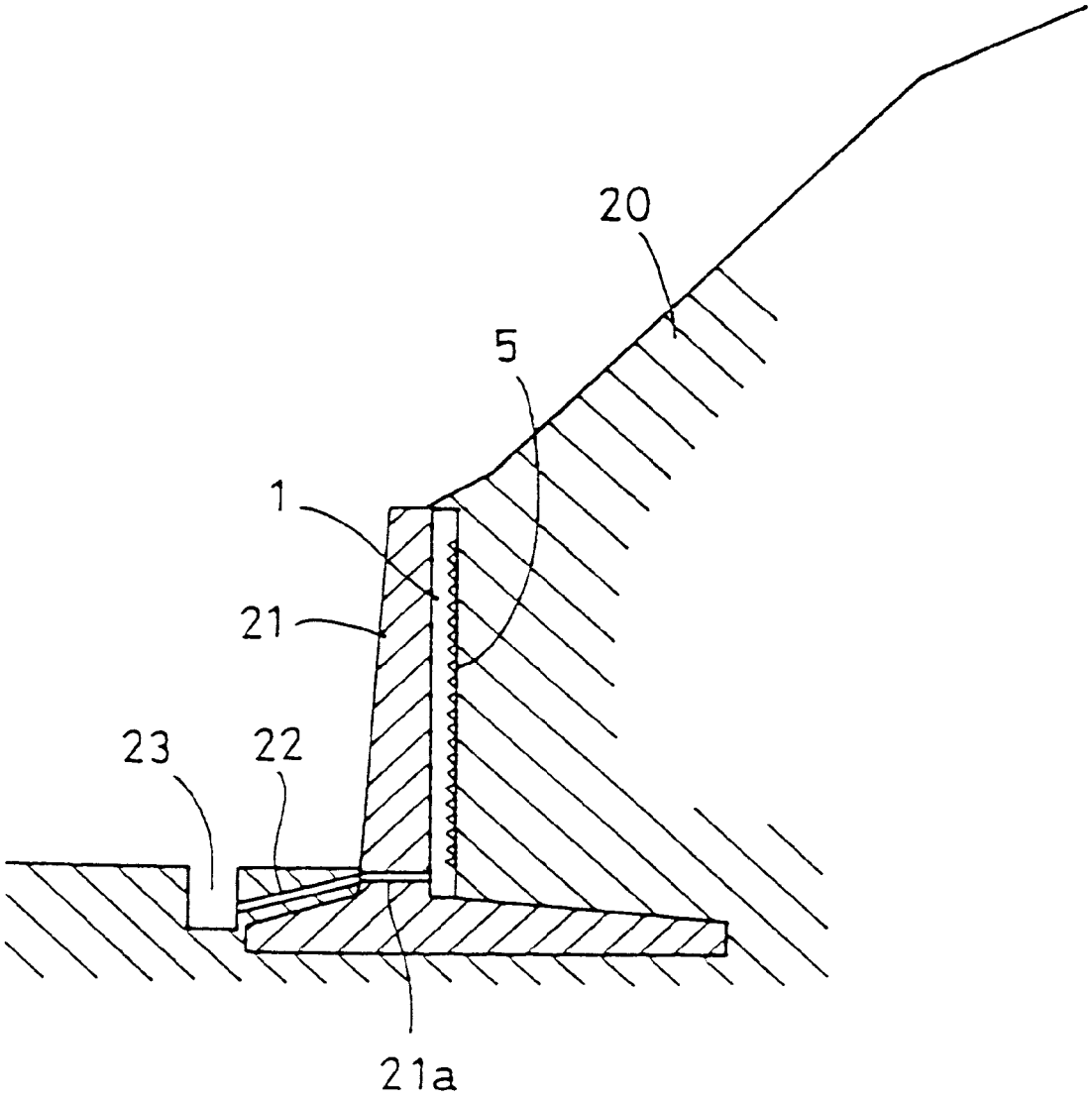
FIG. 16 is a sectional view showing another embodiment of the invention.

FIG. 16 shows an embodiment which is used as a part of a retaining wall. In this embodiment, the partition structures 1 are disposed side by side with their screens 5 facing inward on the inner surface of a concrete retaining wall 21 which is constructed in the lower part of natural ground 20. In the lower portion of the concrete retaining wall 21 are formed draining passages 21*a* which are communicated with the lower part of the respective partition structures 1. In the ground outside of the retaining wall 21 are formed draining passages 22 communicating with the draining passages 21*a* and also a draining channel 23 communicating with the draining passages 22. According to this retaining wall construction, underground water from the natural ground 20 flows into the partition structures 1 through the wedge wire screens 5 and flows out to the draining channel 23 through the draining passages 21*a* and 22 whereby the underground water level in the natural ground 20 is lowered and a disaster such as landslide can be prevented.

Figure 17:
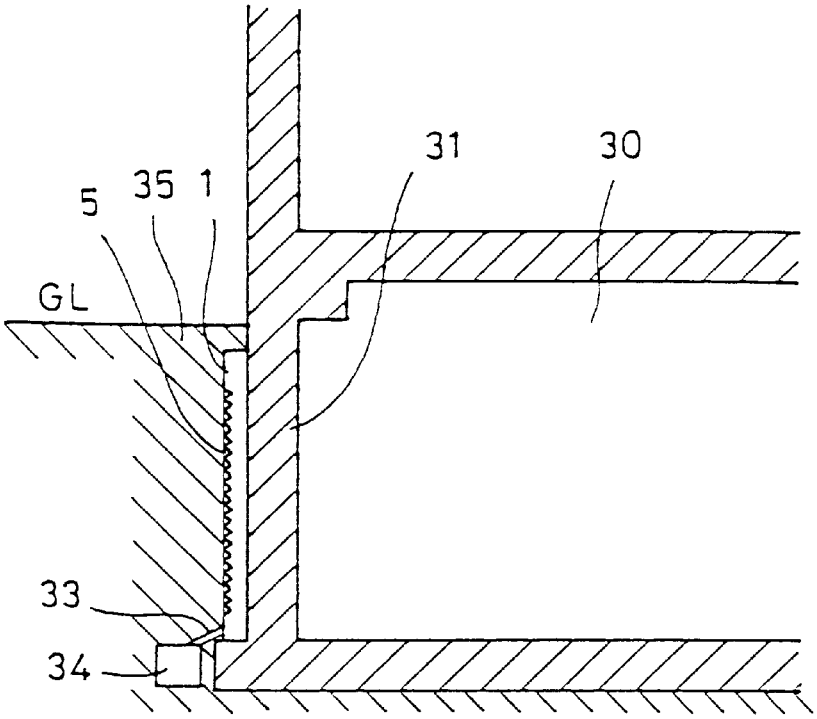
FIG. 17 is a sectional view showing another embodiment of the invention.

FIG. 17 shows an embodiment in which the partition structures 1 is used for draining underground water in ground 35 outside of a basement 30. In this embodiment, a plurality of the partition structures 1 of FIG. 1 are installed side by side adjacent to the outer surface of a wall 31 of the basement 30. The partition structures 1 are installed with their screens 5 facing outward. Draining tubes 33 are connected to the lower portions of the respective partition structures 1 and these draining tubes 33 communicate with a draining pit 34. According to this arrangement, underground water in the ground 35 outside of the basement 30 flows into the partition structures 1 and flows out to the draining pit 34 through the draining tubes 33 whereby the underground water level in the ground 35 outside of the basement 30 is lowered.

Figure 18:
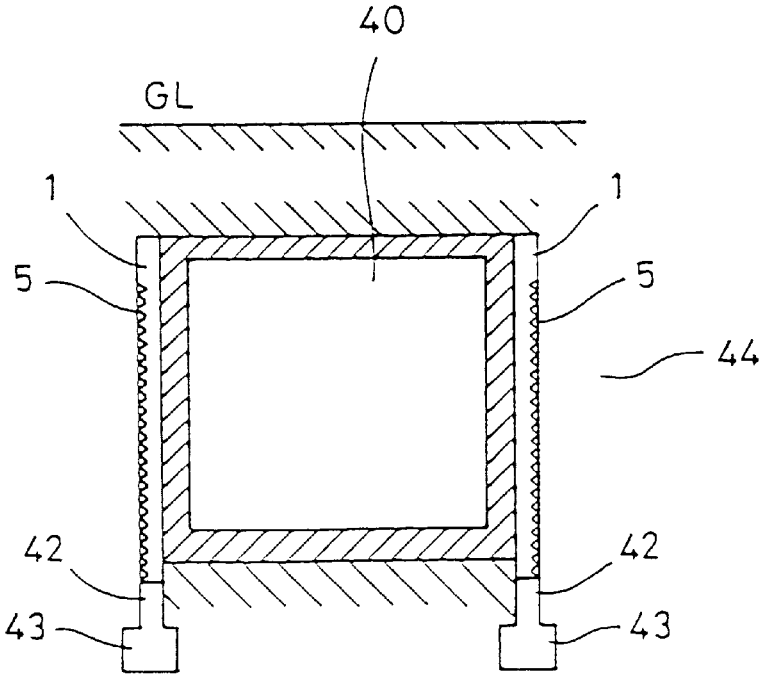
FIG. 18 is a sectional view showing still another embodiment of the invention.

FIG. 18 shows an embodiment in which the partition structures 1 are used for draining underground water in ground on both sides of an underground passage 40. In this embodiment, a plurality of the partition structures 1 of FIG. 1 are installed side by side adjacent to the outer surfaces of both sides of the underground passage 40. The partition structures 1 are installed with their screens 5 facing outward. Communicating passages 42 and draining channels 43 are provided under the partition structures 1 and the lower portions of the partition structures 1 are communicated with the communicating passages 42. Underground water in the ground outside of the underground passage 40 is drained to the draining channels 43 through the screens 5.

Figure 14:
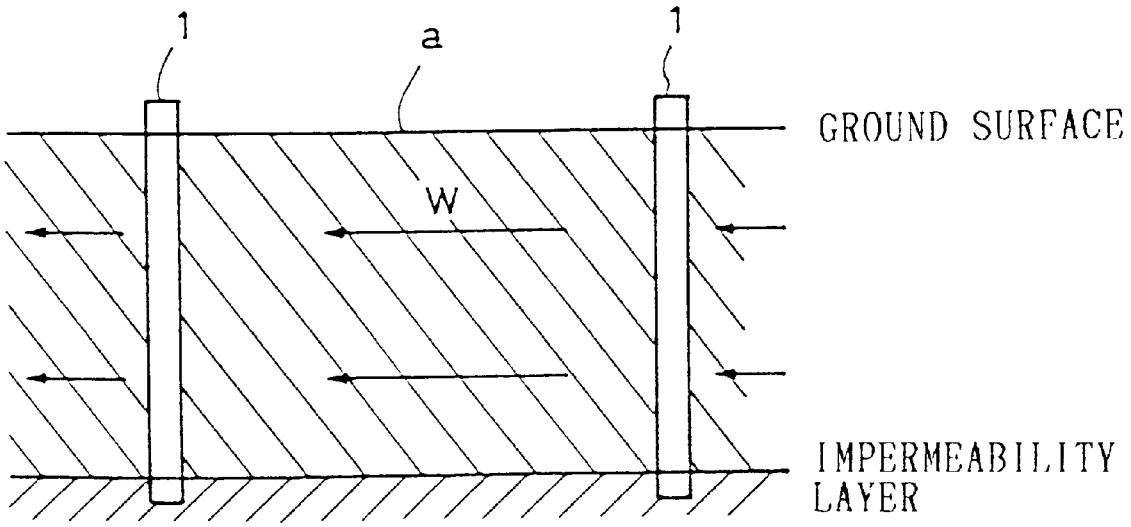
FIG. 14 is a view schematically showing another embodiment of the invention.

In another embodiment of the invention, the pair of main wall members and spacer members are all formed of screens and the partition structures 1 of this embodiment are used as walls of an underground dam. FIG. 14 shows this embodiment. In a case where an underground dam is constructed in ground where flow of underground water W exists, it will be difficult to construct such underground dam if the construction site a is enclosed with normal walls because it will cause rising of the underground water level in the construction site a. By enclosing the construction site a by the partition structures 1 in which all of the main wall members and spacer members are made of screens, the underground water W flows through the partition structures 1 and no rise of the underground water level takes place. Therefore, construction of the underground dam will be made easily. After constructing the underground dam, concrete is filled in the partition spaces of the partition structures 1 and the partition structures 1 can thereby be used as a wall of the underground dam.

The partition structures in which the main wall members and spacer members are all made of screens can also be used as intermediate reinforcing members in a large scale liquid tank.

In another embodiment of the invention, a partition structure may be made in such a manner that a pair of main wall members are formed of flat panels having no screen and spacer members only are formed of screens. This partition structure can be used, for example, as a wall member and, by filling in a cooling gas or liquid or a warming gas or liquid in the partition space and causing such gas or liquid to circulate in the partition space, this wall can be used as a heating or air conditioning equipment.

In the embodiment of FIG. 1, the wedge wire screen 5 is used as a screen. Other screen such, for example, as a slitted screen having a number of slits formed in a flat panel, may also be used.

The constituent elements, i.e., main wall members, side wall members, spacer members, and top and bottom members, can be selectively made of a metal, resin, ceramic or other material. The elements can be fixed together by suitable means such as laser welding in case the elements are made of a metal, supersonic welding in case the elements are made of a resin and bonding in case the elements are made of a ceramic.

In the embodiments shown in FIGS. 1 to 4, the lower end portion of the bottom member is formed in the triangular vertical section and the partition structure 1 is driven into ground by hammering. Alternatively, a a ditch may be formed in the ground and the partition structure 1 may be brought to a location above the ditch by a crane and placed in the ditch. In this case, a bottom member having a flat bottom surface may be used.

What is claimed is:

1. A partition structure having a screen comprising:

a pair of main wall members disposed in parallel to each other with a predetermined interval therebetween;

a pair of side wall members connected at end portions thereof to the end portions of a pair of main wall members to connect said main wall members to each other and provide partition space defined by said main wall members and said side wall members; and one or more spacer members disposed in said partition space fixed to said main wall members to hold the main wall in position;

at least a part of at least one of said main wall members and said spacer members being a screen, said screen of at least one of said main wall members comprising a wedge wire screen support rods arranged in parallel at a predetermined interval and wedge wires arranged in a crossing direction to the support rods with their flat surfaces facing outward and their protecting portions facing inward and being welded to the support rods at each crossing point of the projecting portions to the support rods and slots of a predetermined width being formed between adjacent wedge wires.

2. A partition structure having a screen as defined in claim 1 further comprising:

a top member and a bottom member closing the partition space; and a communicating tube having one end thereof being received in the partition space through the top member and communicating with the partition space and the other end thereof being adapted to be connected to a draining pipe.

3. A partition structure having a screen as defined in claim 1 in which a filling material is filled in at least a part of the partition space.

4. A method for using a partition structure having a screen comprising steps of:

preparing a plurality of partition structures each including a pair of main wall members disposed in parallel to each other with a predetermined interval therebetween, a pair of side wall members connected at end portions thereof to the end portions of the pair of main wall members to connect said main wall members to each other and provide partition space defined by said main wall members and said side wall members, one or more spacer members disposed in said partition space fixed to said main wall members to hold the main wall members in position, at least a part of at least one of said main wall members being a a wedge wire screen consisting of support rods arranged in a crossing direction to the support rods with their flat surfaces facing outward and their projecting portions facing inward and being welded to the support rods at each crossing point of the protecting portions to the support rods and slots of a predetermined width being formed between adjacent wedge wires, a top member and a bottom member closing the partition space, and a communicating tube having one end thereof being received in the partition space through the top member and communicating with the partition space and the other end thereof being adapted to be connected to a draining pump;

installing said plurality of partition structures side by side at least partly in ground with the screen facing inwardly and with the side wall embers of the adjacent partition structures being in contact with each other thereby enclosing a predetermined construction site with said plurality of partition structures;

connecting a draining pump to the communicating tube of the partition structure; and actuating the draining pump for draining underground water flowing into the partition space through the screen and thereby lowering the underground water level in the construction site.

5. A method for using a partition structure having a screen comprising steps of:

preparing a plurality of partition structures each including a pair of main wall members disposed in parallel to each other with a predetermined interval therebetween, a pair of side wall members connected at end portions thereof to the end portions of the pair of main wall members to connect said main wall members to each other and provide a partition space defined by said main wall members and said side wall members, and one or more spacer members disposed in said partition space fixed to said main wall members to hold the main wall members in position, at least a part of at least one of said main wall members being a wedge wire screen consisting of support rods arranged in a crossing direction to the support rods with their flat surfaces facing outward and their projecting portions facing inward and being welded to the support rods at each crossing point of the projecting portions to the support rods and slots of a predetermined width being formed between adjacent wedge wires;

providing a drainage around a predetermined construction;

installing said plurality of partition structures side by side at least partly in ground with the side wall members of the adjacent partition structures being in contact with each other, with one of the main wall members of the partition structure being adjacent to an outer wall surface of the predetermined construction, with the screen facing a side opposite to the main wall members adjacent to the outer wall of the predetermined construction, and with the lower portions of the partition structures being in communication with the drainage, thereby for draining underground water flowing into the partition space through the screen and lower the underground water level in the ground in the vicinity of the predetermined construction.

* * * * *